US006823637B2

(12) United States Patent
Elliott et al.

(10) Patent No.: US 6,823,637 B2
(45) Date of Patent: Nov. 30, 2004

(54) SHINGLE WITH A RENDERED SHADOW DESIGN

(75) Inventors: Bert W. Elliott, Westerville, OH (US); David P. Aschenbeck, Newark, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/334,356

(22) Filed: Dec. 31, 2002

(65) Prior Publication Data

US 2004/0123543 A1 Jul. 1, 2004

(51) Int. Cl.[7] ..... E04D 1/26

(52) U.S. Cl. ..... 52/557; 52/314; 52/554; 52/555

(58) Field of Search ..... 52/554, 555, 314, 52/557; D25/139–141

(56) References Cited

U.S. PATENT DOCUMENTS

D314,439 S 2/1991 Jenkins et al.
D317,506 S 6/1991 Jenkins et al.
D388,195 S 12/1997 Hannah et al.

*Primary Examiner*—Korie Chan
(74) *Attorney, Agent, or Firm*—Inger H. Eckert; James J. Dottavio

(57) ABSTRACT

A laminated shingle has a rendered shadow design when placed with other similar shingles on a roof deck. The laminated shingle includes an overlay member and an underlay member fixedly attached to each other. The overlay member includes an upper or headlap portion and a lower or exposed butt portion with one or more tabs separated by cutouts. The underlay member is coated with a layer of relatively dark granules to form vertically and horizontally-oriented underlay shading areas. In one embodiment, one or both vertical edges of at least one tab are generally parallel to the vertically-oriented longitudinal axis of the vertically-oriented shading area to expose a portion of the shading area.

6 Claims, 9 Drawing Sheets

SHINGLE WITH A RENDERED SHADOW DESIGN

TECHNICAL FIELD

This invention relates in general to a shingle, and in particular, to a laminated roofing shingle including an overlay with cutouts and tabs and an underlay with shadow lines such that the shingle provides a three-dimensional effect with richness and depth.

BACKGROUND OF THE INVENTION

In the past, roofing shingles have had to satisfy two main functions when applied to a roof deck. The first function is to provide a durable, weatherproof covering for the roof deck. Roof shingles, whatever their form, are intended to provide a means of sheltering the structure below the shingles from precipitation and the deleterious effects of sun and wind. Roof shingles installed on the roof deck must perform these protecting functions for a reasonable period of time. The second function is to present an aesthetically pleasing architectural feature which enhances the overall appeal of the structure to which the shingles have been applied. This aesthetic function has been satisfied by providing asphalt shingles with various butt edge contours and surface treatments which operate to simulate more traditional, and in most cases more expensive, forms of roof coverings, such as thatch, wooden shakes, slates, and even tiles of various forms.

Although several attempts have been made to design a laminated shingle with a shadow look, there is a need to produce a shingle on a production scale with a high style shadow look.

SUMMARY OF THE INVENTION

This invention relates to a laminated shingle. In one embodiment, the laminated shingle comprises an overlay member and an underlay member. The overlay member has a front surface, a rear surface, an upper portion, and a lower portion. The lower portion includes one or more tabs having non-parallel vertical edges. The tabs are separated by cutouts. At least one cutout includes a pair of spaced apart non-parallel vertical edges extending from a lower boundary of the upper portion of the overlay member to a lower edge of the lower portion of the overlay member. A width of the at least one tab at the lower boundary of the upper portion of the overlay member is larger than a width of the at least one tab at the lower edge of the lower portion of the overlay member. At least one cutout also includes an upper edge extending between the pair of cutout vertical edges.

The underlay member includes a front surface attached to the rear surface of the overlay member, and includes a layer of granules on the front surface to form at least one vertically-oriented underlay shading area having two substantially vertical edges. At least one edge of the underlay shading area is substantially parallel to an edge of the tab of the overlay member. The vertically-oriented underlay shading area is darker in appearance than a portion of a remainder of the underlay member. One of the cutout vertical edges is arranged so that it is positioned between the vertical edges of the underlay shading area, thereby exposing a portion of the vertically-oriented underlay shading area.

According to this invention, there is also provided a laminated shingle including an overlay member having a front surface, a rear surface, an upper portion and a lower portion, the lower portion includes one or more tabs separated by cutouts. At least one tab includes a pair of substantially parallel upper vertical edge portions and a pair of substantially parallel lower vertical edge portions. At least one cutout includes a pair of spaced apart substantially parallel upper vertical edges and a pair of spaced apart non-parallel lower vertical edges. The combined upper vertical edges and lower vertical edges extend from a lower boundary of the upper portion of the overlay member to a lower edge of the lower portion of the overlay member. The at least one cutout also includes an upper edge extending between the pair of cutout upper vertical edge portions. An underlay member includes a front surface attached to the rear surface of the overlay member, and includes a layer of granules on the front surface to form at least one vertically-oriented underlay shading area having two substantially vertical edges. At least one edge of the underlay shading area has a contour substantially corresponding to the contour of the upper and lower edge portions of the tab of the overlay member. The vertically-oriented underlay shading area is darker in appearance than a portion of a remainder of the underlay member. One of the combined upper vertical edges and lower vertical edges of the cutout is arranged so that it is positioned between the vertical edges of the underlay shading area, thereby exposing a portion of the vertically-oriented underlay shading area.

According to the invention there is also provided a laminate shingle including an overlay member having a front surface, a rear surface, an upper portion, and a lower portion. The lower portion includes one or more tabs having non-parallel vertical edges. The tabs are separated by cutouts. At least one cutout includes a pair of spaced apart non-parallel vertical edges extending from a lower boundary of the upper portion of the overlay member to a lower edge of the lower portion of the overlay member. A width of the at least one tab at the lower boundary of the upper portion of the overlay member is smaller than a width of the at least one tab at the lower edge of the lower portion of the overlay member. A lower edge of the at least one tab has a substantially curve contour. The at least one cutout also includes an upper edge extending between the pair of cutout vertical edges. An underlay member includes a front surface attached to the rear surface of the overlay member, and includes a layer of granules on the front surface to form at least one vertically-oriented underlay shading area having two substantially vertical edges. At least a portion of a lower edge of the underlay shading area has a substantially curved contour. At least one vertical edge of the underlay shading area is substantially parallel to an edge of the tab of the overlay member. The vertically-oriented underlay shading area is preferably darker in appearance than a portion of a remainder of the underlay member. One of the cutout vertical edges is arranged so that it is positioned between the vertical edges of the underlay shading area, thereby exposing a portion of at least one vertical edge and at least a portion of the lower edge of the vertically-oriented underlay shading area.

According to the invention there is also provided a laminate shingle including an overlay member having a front surface, a rear surface, an upper portion, and a lower portion. The lower portion includes one or more tabs having non-parallel vertical edges. The tabs are separated by cutouts. At least one cutout includes a pair of spaced apart non-parallel vertical edges extending from a lower boundary of the upper portion of the overlay member to a lower edge of the lower portion of the overlay member. A width of at least one tab at the lower boundary of the upper portion of the overlay member is smaller than a width of the at least one tab at the lower edge of the lower portion of the overlay member. A lower edge of the at least one tab has a substantially curve contour. The at least one cutout also includes an upper edge extending between the pair of cutout vertical edges. An underlay member includes a front surface attached to the rear surface of the overlay member, and includes a layer of granules on the front surface to form at least one underlay shading area. At least a portion of a lower edge of the underlay shading area has a substantially curved contour. The underlay shading area is darker in appearance than a portion of a remainder of the underlay member. One of the tabs is arranged so that it covers a portion of the underlay shading area, thereby exposing a portion of the lower edge of the underlay shading area.

According to the invention there is also provided a laminate shingle including an overlay member having a front surface, a rear surface, an upper portion, and a lower portion. The lower portion includes one or more tabs having vertically-oriented longitudinal axis substantially parallel to a vertical axis of the overlay member. The tabs are separated by cutouts. At least one cutout includes a pair of spaced apart non-parallel vertical edges extending from a lower boundary of the upper portion of the overlay member to a lower edge of the lower portion of the overlay member. A width of the tab at the lower boundary of the upper portion of the overlay member is smaller than a width of the tab at the lower edge of the lower portion of the overlay member. A lower edge of at least one tab has a substantially curve contour. The longitudinal axis of the overlay member bisects the curve lower edge of the tab. The at least one cutout also includes an upper edge extending between the pair of cutout vertical edges. An underlay member includes a front surface attached to the rear surface of the overlay member, and includes a layer of granules on the front surface to form at least one underlay shading area having a vertically-oriented longitudinal axis substantially parallel to a vertical axis of the underlay member. At least a portion of a lower edge of the underlay shading area has a substantially curved contour. The longitudinal axis of the underlay shading area bisecting the curved lower edge of the underlay shading area. The underlay shading area is darker in appearance than a portion of a remainder of the underlay member. One of the tabs is arranged so that it covers a portion of the underlay shading area, the vertically-oriented longitudinal axis of the tab is horizontally offset from the vertically-oriented longitudinal axis of the underlay, thereby exposing a portion of the lower edge of the underlay shading area.

According to the invention there is also provided a laminate shingle including an overlay member having a front surface, a rear surface, an upper portion, and a lower portion. The lower portion includes one or more tabs separated by cutouts. At least one cutout includes a pair of spaced apart vertical edges extending from a lower boundary of the upper portion of the overlay member to a lower edge of the lower portion of the overlay member. A lower edge of the at least one tab has a substantially curved contour. The at least one cutout also including an upper edge extending between the pair of vertical cutout edges. An underlay member includes a front surface attached to the rear surface of the overlay member, and includes a layer of granules on the front surface to form at least one underlay shading area. At least a portion of a lower edge of the underlay shading area has a substantially curved contour. The underlay shading area is darker in appearance than a portion of a remainder of the underlay member. The curved contour of the underlay shading area extends substantially along the curved lower edge of the tab. One of the tabs is arranged so that it covers a portion of the underlay shading area, thereby exposing a portion of the curved lower edge of the underlay shading area having a tapered appearance. The exposed portion of the curved lower edge of the underlay shading area has a vertical thickness at one side of the curved lower edge that is greater than a vertical thickness at the other side of the curved lower edge.

According to the invention there is also provided a laminate shingle including an overlay member having a front surface, a rear surface, an upper portion, and a lower portion. The lower portion includes one or more tabs having substantially parallel vertical edges separated by cutouts. At least one cutout includes an upper edge extending between a pair of spaced part substantially parallel vertical edges. The cutout upper edge has a substantially curved contour and is substantially aligned with a lower boundary of the upper portion of the overlay member. The vertical edges of the cutout extend from the cutout upper edge to a lower edge of the lower portion of the overlay member. A lower edge of at least one tab also has a substantially curved contour. An underlay member includes a front surface attached to the rear surface of the overlay member, and includes a layer of granules on the front surface to form at least one vertically-oriented underlay shading area having at least two substantially vertical edges. At least a portion of a lower edge of the underlay shading area has a generally curved contour. At least one of the two vertical edges of the underlay shading area is substantially parallel to an edge of the tab of the overlay member. The vertically-oriented underlay shading area is darker in appearance than a portion of a remainder of the underlay member. One of the cutout vertical edges is arranged so that it is positioned between the vertical edges of the underlay shading area, thereby exposing a portion of at least one shading area vertical edge and at least a portion of the lower edge of the underlay shading area.

According to the invention there is also provided a laminate shingle including an overlay member having a front surface, a rear surface, an upper portion, and a lower portion. The lower portion includes one or more tabs having substantially parallel vertical edges separated by cutouts. At least one cutout includes an upper edge extending between a pair of spaced part substantially parallel vertical edges. The cutout upper edge has a substantially curved contour and is substantially aligned with a lower boundary of the upper portion of the overlay member. The vertical edges of the cutout extend from the cutout upper edge to a lower edge of the lower portion of the overlay member. A lower edge of at least one tab also has a substantially curved contour. An underlay member includes a front surface attached to the rear surface of the overlay member, and includes a layer of granules on the front surface to form at least one vertically-oriented underlay shading area having at least one substantially vertical edge. At least a portion of a lower edge of the underlay shading area has a generally curved contour. The at least one vertical edge of the underlay shading area is substantially parallel to an edge of the tab of the overlay member. The vertically-oriented underlay shading area is darker in appearance than a portion of a remainder of the underlay member. One of the tabs is arranged so that it covers a portion of the underlay shading area, thereby exposing a portion of the underlay shading area lower edge, and exposing a portion of the at least one substantially vertical edge of the underlay shading area.

According to the invention there is also provided a laminate shingle including an overlay member having a front surface, a rear surface, an upper portion, and a lower portion. The lower portion includes one or more tabs separated by cutouts. At least one tab has a centerline substantially parallel to a vertical axis of the overlay member. At least one cutout includes a pair of vertical edges extending from a lower boundary of the upper portion of the overlay member to a lower edge of the overlay member. An upper edge extends between the pair of vertical edges. An underlay member has a front surface attached to the rear surface of the overlay member. The underlay member includes a layer of granules on the front surface to form vertically-oriented, generally elongated underlay shading areas having vertically-oriented longitudinal axes. The axes are substantially parallel to a vertical axis of the underlay member. At least one edge of the underlay shading area is at an acute angle to an edge of the tab of the overlay member. The centerline of at least one tab of the overlay member substantially aligns with a vertically-oriented longitudinal axis of the underlay shading areas to expose a portion of at least one of the underlay shading areas. A width of the exposed portions of the underlay shading areas at the lower edge of the overlay member is larger than a width of the exposed portions of the underlay shading areas at the lower boundary of the upper portion of the overlay member.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
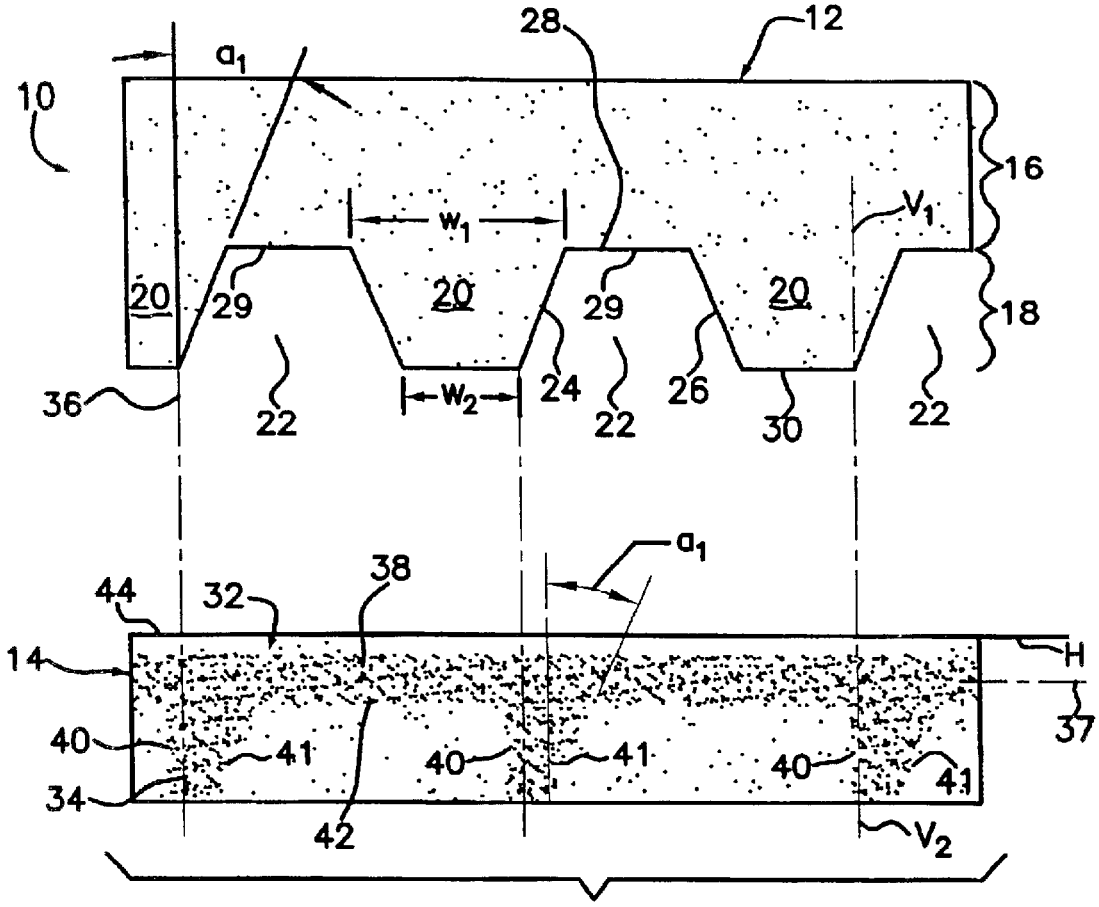
FIG. 1 is an exploded plan view of a shingle with a rendered shadow design according to a first embodiment of the invention.
Figure 2:
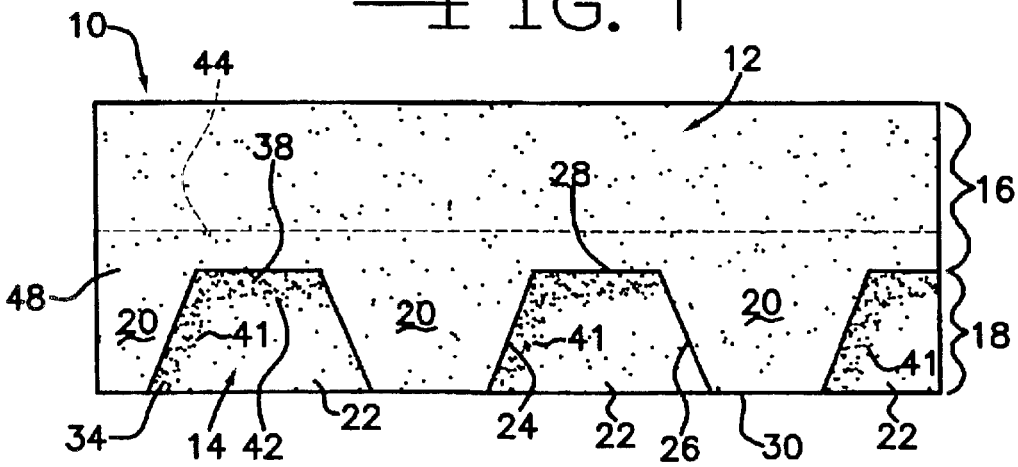
FIG. 2 is a plan view of the completed shingle of FIG. 1.
Figure 3:
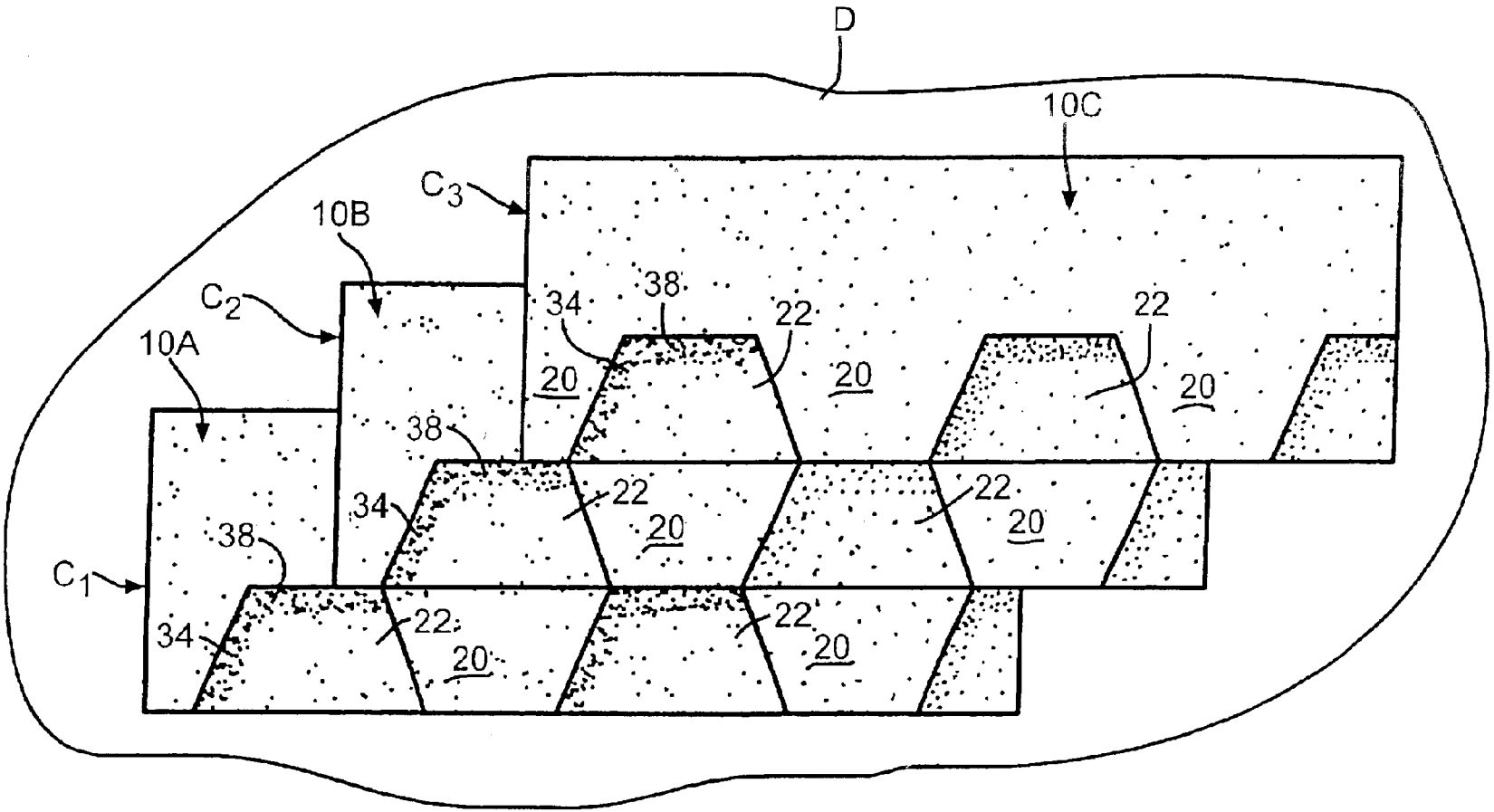
FIG. 3 is a plan view of a portion of a roof deck covered with the shingles of FIG. 1.

Referring now to the drawings, there is illustrated in FIGS. 1–3 a shingle, shown generally at 10, according to a first embodiment of the invention. The shingle 10 is of a type of roofing shingle generally known as a laminated type shingle consisting of an overlay member 12 and an underlay member 14. The overlay and underlay members 12 and 14 are preferably constructed of a suitable mat of fiberglass or other construction that is permeated with a preferably asphaltic substance of a type well-known in the art. Typically, a plurality of granules is dispersed over the front surface and is held by the adhesive characteristics of the asphaltic substance permeating the front surface. It should be appreciated that the invention is not limited by the material composition of the overlay and underlay members 12 and 14. For example, the overlay and underlay members 12 and 14 may comprise a laminar felted material comprising organic or inorganic fibers, or a mixture of both, that are held together with a binding agent. The fibers may be subsequently coated, saturated, or otherwise impregnated with an asphaltic bituminous material according to processes well known in the roofing industry.

The overlay member 12 includes a headlap or upper portion 16 and an exposed butt or lower portion 18. The lower portion 18 includes one or more tabs 20 and preferably a series of tabs, which are separated from one another by one or more cutouts 22. Each cutout 22 includes a pair of spaced apart non-parallel vertical edges 24 and 26 extending from a lower boundary 28 of the upper portion 16 of the overlay member 12 to a lower edge 30 of the lower portion 18 of the overlay member 12. Preferably, a width $W_1$ of the tab 20 at the lower boundary 28 of the upper portion 16 of the overlay member 12 is larger than a width $W_2$ of the tab 20 at the lower edge 30 of the lower portion 18 of the overlay member 12. The lower boundary 28 of the upper portion 16 of the overlay member 12 forms an upper edge 29 of each cutout 22 extending between the pair of vertical edges 24 and 26.

In the first embodiment, the underlay member 14 includes a layer of granules 32 on the front surface. Preferably, the layer of granules 32 is applied to the front surface with such a preciseness as to form one or more vertically-oriented underlay shading areas 34. The vertically-oriented underlay shading areas 34 have substantially vertical edges 40 and 41. The edge 41 is preferably substantially parallel to the edge 24 of the tab 20. Preferably, the vertically-oriented underlay shading areas 34 are darker in appearance than a portion of a remainder of the underlay member 14, which can be covered with background granules of a lighter color. Alternatively, any one or more of the shading areas described in this application comprises granules of a different shade, color, or blend drop that the remainder of the underlay member. Additionally, the rest of the shading areas may be lighter, darker, or the same.

As best shown in FIG. 1, each vertically-oriented underlay shading area 34 has a vertically-oriented longitudinal axis 36 that is substantially parallel to a vertical axis $V_2$ of the underlay member 14. Additionally, each cutout 22 is arranged such that the cutout vertical edge 24 is positioned between the vertical edges 40 and 41 of the underlay shading area 34, thereby exposing a portion of the vertically-oriented underlay shading area 34 of the underlay member 14. As used herein, the term "vertical" means having an acute angle $a_1$ less than about 60 degrees as measured from a line substantially parallel to one of a vertical axis $V_1$ of the overlay member 12. Preferably, the angle $a_1$ is less than about 45 degrees. In the first embodiment, the underlay shading areas 34 are exposed within the cutouts 22 only on a specific side of each tab 20, such as the right hand side, to provide a uniform shadow rendering design to the roof. However, it will be appreciated that the underlay shading areas 34 can be exposed only on the left hand side of the tabs, or any combination thereof.

It can be seen that the cutout vertical edge 24 is arranged so that it is positioned horizontally between the vertical edges 40 and 41 of the underlay shading area 34 of the underlay member, thereby exposing a portion of the vertically-oriented underlay shading area 34 of the underlay member 14. Also, it can be seen that the right hand edges 41 of the vertically-oriented underlay shading areas 34 are arranged so that they are positioned between the vertical edges 24 and 26 of the cutouts, thereby exposing a portion of the vertically-oriented underlay shading area 34 of the underlay member 14.

In addition, it is desirable that edges 40 and 41 of the underlay shading area 34 are generally non-linear or non-sharp to provide a more realistic shadow rendering design. In other words, the edges 40 and 41 of the underlay shading areas 34 do not form a sharp demarcation at the junction between the underlay shading area edges 40 and 41 and the remainder of the underlay member 14. As a result, the granules forming the underlay shading areas 34 should be slightly blended with the granules on the remainder of the underlay member 14 to provide a more realistic appearance.

In addition, in the first embodiment of the invention shown in FIGS. 1–3, the layer of granules 32 also forms a horizontally-oriented underlay shading area 38 to cause a portion of the front surface of the underlay 14 to appear dark or black in appearance in contrast to a portion of a remainder of the underlay granules. Preferably, the horizontally-oriented underlay shading area 38 has a horizontally-oriented longitudinal axis 37 that is substantially parallel to a horizontal axis H of the underlay member 14.

In a manner similar to the non-linear edges 40 and 41 of the underlay shading area 34, it is desirable that a lower edge 42 of the underlay shading area 38 is generally non-linear or non-sharp to provide a more realistic shadow rendering design. The horizontally-oriented underlay shading area 38 is formed such that the lower boundary 28 of the upper portion or headlap 16 exposes a portion of the horizontally-oriented underlay shading area 38 when the laminated shingle 10 is formed. The preciseness required to form the underlay shading areas 34 and 38 can be achieved by using a pneumatic granule blender (not shown), as described in co-assigned U.S. Pat. No. 5,746,830, herein incorporated by reference. It can be seen that the vertical and horizontal underlay shading areas 34 and 38 could be referred to as first and second shading areas, in no particular order, and therefore the underlay 14 and overlay 12 combine to form two shading areas, a first shading area having a vertically-oriented longitudinal axis parallel to the vertical axis $V_2$ of the underlay member 14 and a second shading area having a horizontally-oriented longitudinal axis substantially parallel to the horizontal axis H of the underlay member 14.

To form the laminated shingle 10 of the invention, the rear surface of the overlay member 12 and the front surface of the underlay member 14 are fixedly attached to each other, as best shown in FIG. 2. This can be accomplished by using adhesive materials applied to the front surface of the underlay member 14 and the rear surface of the overlay member 12 in a variety of different ways. For example, an adhesive may be applied between each tab 20 of the overlay member 12 and the corresponding underlying portion of the underlay member 14. Additionally, it may be desirable to provide a common bonding area 43 defined by the area of overlap between an upper edge 44 of the underlay member 14 and the lower boundary 28 of the overlay member 12. Preferably, the common bonding area 43 extends substantially the entire width of the shingle 10 proximate to the lower boundary 28 of the overlay member 16. The height of the common bonding area 43 depends on the height of the cutouts 22 with respect to the height of the underlay member 14. In addition, the height of the common bonding area 42 depends on the height of the completed shingle 10. For the completed shingle 10 having a width of approximately 40 inches (101.6 cm) and an overall height of approximately 17.0 inches (43.2 cm), the common bonding area 42 has a width in the range of about 1 to 2 inches, and more preferably about 1.5 inches (3.8 cm). It should be appreciated that the invention is not limited by the dimensions of the shingle 10, and that the invention can be practiced with any dimensions. For example, the width of the shingle 10 may be approximately 36 inches (91.4 cm) and the height 34 may be approximately 24.0 inches (61.0 cm).

Referring now to FIG. 3, there is illustrated a fragmentary roof deck, D, with a roof covering made with a plurality of roofing shingles 10 according to the first embodiment of the invention. In general, roofing shingles arranged in a series of horizontal courses of which a portion of three such courses C1, C2 and C3 are shown. Shingle 10A in course C1 is shown being overlapped by shingle 10B in course C2. Likewise, shingle 10B in course C2 is shown being overlapped by shingle 10C in course C3. The extreme left-most and right-most edges of shingles 10A, 10B, 10C are shown without adjoining shingles which would normally precede and succeed these shingles in each of the courses, C1, C2, C3. This is done in order to more fully illustrate the desired placement of each shingle in each overlapping course. Thus, it is understood that the roof deck, D, in the finished roof covering would be substantially completely covered by a plurality of substantially identically shaped shingles 10A, 10B, and 10C. It may be desirable to offset each overlapping course to prevent the joint which is formed between each adjacent shingle in each course from corresponding to the joint between the shingles in the subsequent overlapping course. If this were not done, water from precipitation would inevitably penetrate these joints and find its way to potentially damage the underlying roof deck, D. In offsetting these joints, there is no direct path for such water between each shingle. In addition to preventing the penetration of water from precipitation, offsetting shingles in subsequent overlapping courses provides an overall aesthetic effect.

Figure 4:
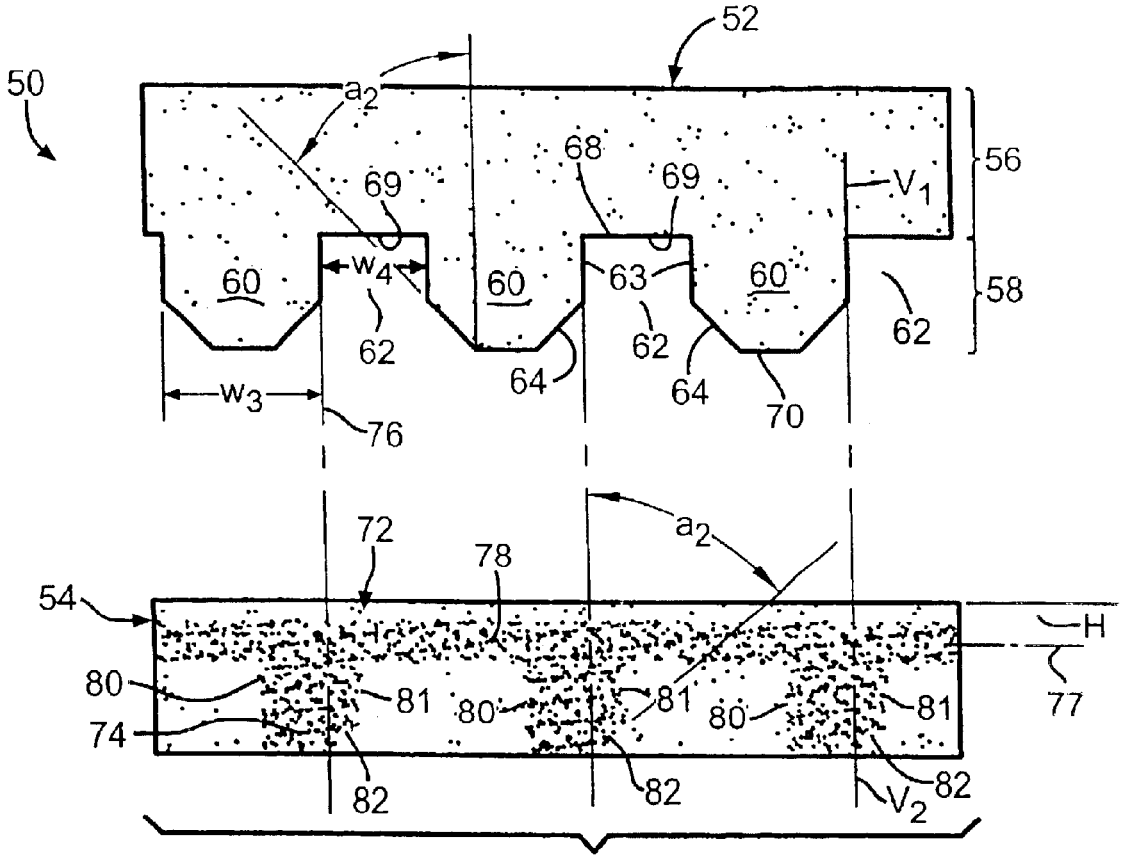
FIG. 4 is an exploded plan view of a shingle with a rendered shadow design according to a second embodiment of the invention.
Figure 5:
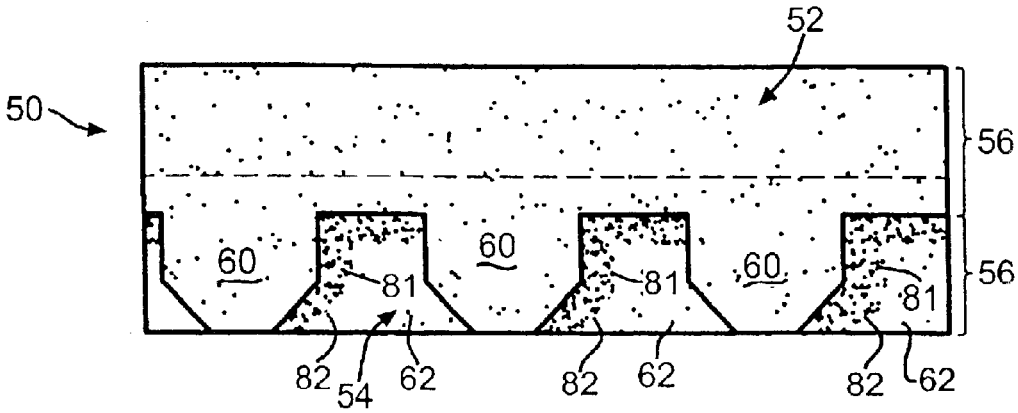
FIG. 5 is a plan view of the completed shingle of FIG. 4.

FIGS. 4 and 5 illustrate a shingle 50 according to a second embodiment of the invention. In the second embodiment, the overlay member 52 includes a headlap or upper portion 56 and an exposed butt or lower portion 58. The lower portion 58 includes one or more tabs 60 and preferably a series of tabs, which are separated from one another by one or more cutouts 62. Each cutout 62 includes a pair of substantially parallel upper vertical edges 63, and a pair of non-parallel lower vertical edges 64. The combined upper vertical edges 63 and lower vertical edges 64 extend from a lower boundary 68 of the upper portion 56 of the overlay member 52 to a lower edge 70 of the lower portion 58 of the overlay member 52. Preferably, a width $W_3$ of the tab 60 is larger than a width $W_4$ of the cutout 62. However, it will be appreciated that the width $W_3$ of each tab 60 and the width $W_4$ of each cutout 62 can be selected to any desirable dimension. The lower boundary 68 of the upper portion 56 of the overlay member 52 forms an upper edge 69 of each cutout 62 extending between the pair of upper vertical edges 63.

In the second embodiment, the underlay member 54 includes a layer of granules 72 applied to the front surface with such a preciseness as to form one or more vertically-oriented underlay shading areas 74. The vertically-oriented underlay shading areas 74 have a substantially vertical upper edge 81 and a substantially vertical lower edge 82. The contour of the edges 81 and 82 preferably substantially correspond to the contour of the upper and lower edges 63 and 64, respectively, of the tabs 60. Preferably, the vertically-oriented underlay shading areas 74 are darker in appearance than a portion of a remainder of the underlay member 54, which can be covered with background granules of a lighter color.

As best shown in FIG. 4, each vertically-oriented underlay shading area 74 has a vertically-oriented longitudinal axis 76 that is substantially parallel to a vertical axis $V_2$ of the underlay member 54. Additionally, each cutout 62 is arranged such that the combined upper vertical edge 63 and lower vertical edge 64 is positioned between the vertical edges 80 and 81 of the underlay shading area 74, thereby exposing a portion of the vertically-oriented underlay shading area 74 of the underlay member 54. As used herein, the term "vertical" means having an acute angle $a_2$ less than about 60 degrees as measured from a line substantially parallel to one of a vertical axis $V_1$ of the overlay member 52. Preferably, the angle $a_2$ is less than about 45 degrees. In the second embodiment, the underlay shading areas 74 are exposed within the cutout 62 only on a specific side of each tab 60, such as the right hand side, to provide a uniform shadow rendering design to the roof. However, it will be appreciated that the underlay shading areas 74 can be exposed only on the left hand side of the tabs, or any combination thereof.

It can be seen that the combined upper vertical edge 63 and lower vertical edge 64 of the cutout 62 is arranged so that it is positioned horizontally between the vertical edges 80 and 81 of the underlay shading area 74 of the underlay member, thereby exposing a portion of the vertically-oriented underlay shading area 74 of the underlay member 54. Also, it can be seen that the right hand edges 81 of the vertically-oriented underlay shading areas 74 are arranged so that they are positioned between the combined upper vertical edge 63 and lower vertical edge 64 of the cutouts 62, thereby exposing a portion of the vertically-oriented underlay shading area 74 of the underlay member 54.

In addition, in the embodiment of the invention shown in FIGS. 4–5, the layer of granules 72 also forms a horizontally-oriented underlay shading area 78 to cause a portion of the front surface of the underlay 54 to appear dark or black in appearance in contrast to a portion of a remainder of the underlay granules. Preferably, the horizontally-oriented underlay shading area 78 has a horizontally-oriented longitudinal axis 77 that is substantially parallel to the horizontal axis H of the underlay member 54. In most other aspects, the second embodiment of the shingle 50 is substantially identical to the shingle 10 (FIG. 1).

Figure 6:
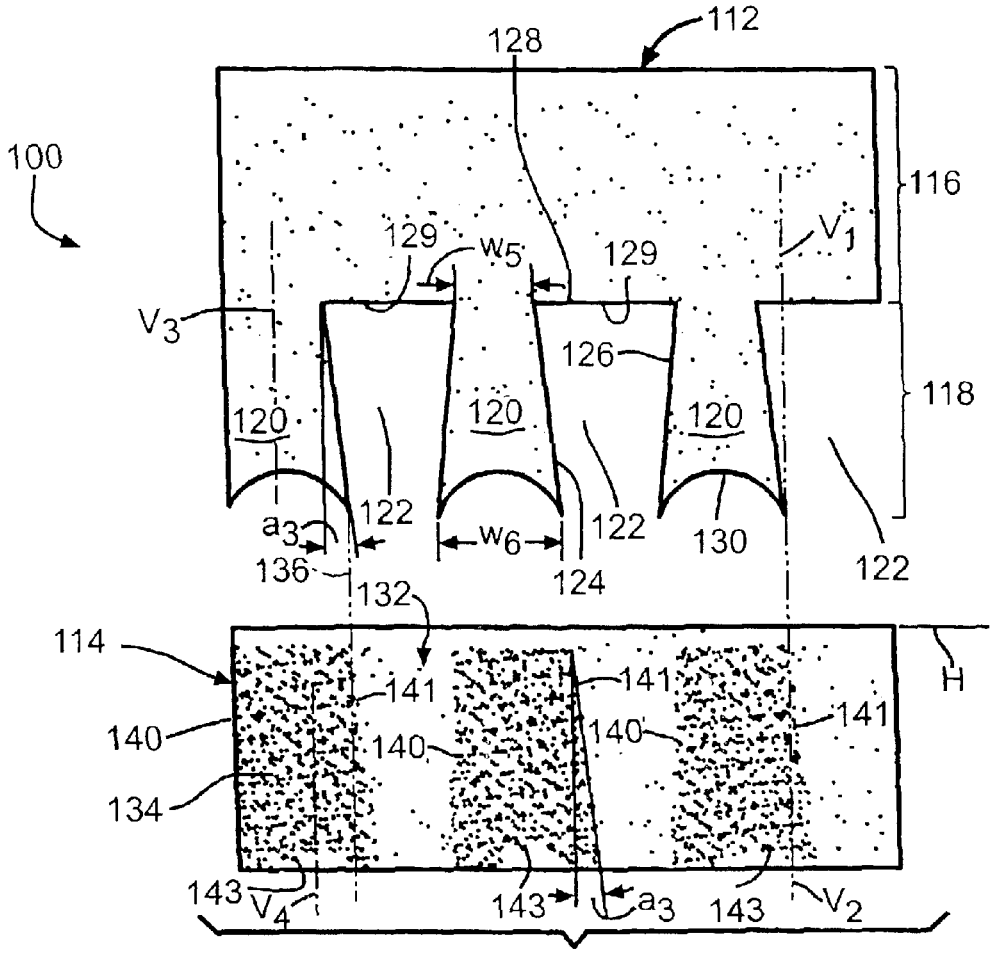
FIG. 6 is an exploded plan view of a shingle with a rendered shadow design according to a third embodiment of the invention.
Figure 7:
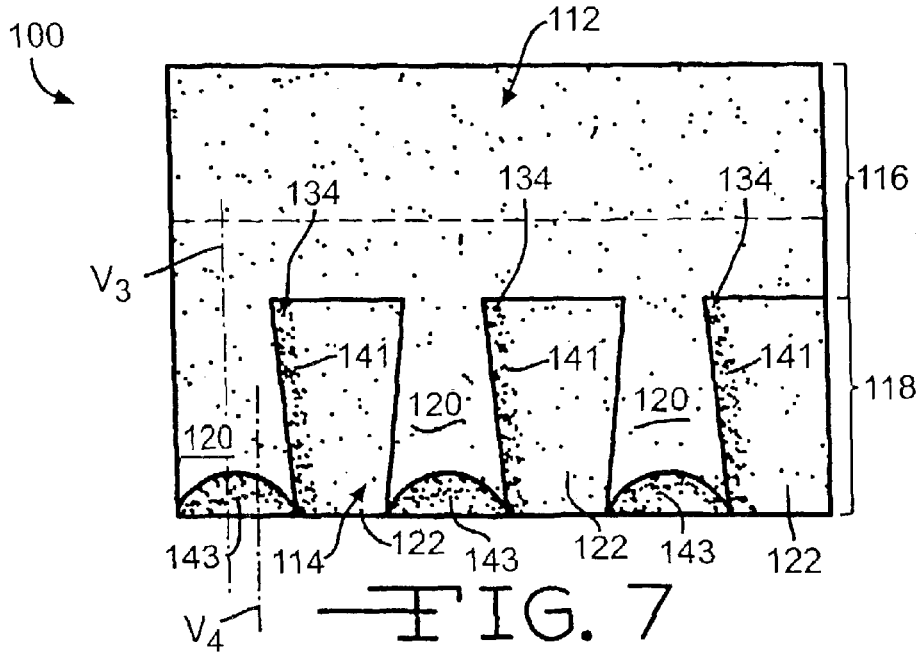
FIG. 7 is a plan view of the completed shingle of FIG. 6.

FIGS. 6 and 7 illustrate a shingle 100 according to a third embodiment of the invention. In the third embodiment, the overlay member 112 includes a headlap or upper portion 116 and an exposed butt or lower portion 118. The lower portion 118 includes one or more tabs 120 and preferably a series of tabs, which are separated from one another by one or more cutouts 122. Each cutout 122 includes a pair of spaced apart non-parallel vertical edges 124 and 126 extending from a lower boundary 128 of the upper portion 116 of the overlay member 112 to a lower edge 130 of the tab 120. Preferably, a width $W_5$ of the tab 120 at the lower boundary 128 of the upper portion 116 of the overlay member 12 is smaller than a width $W_6$ of the tab 120 at the lower edge 130 of the lower portion 118 of the overlay member 112. The lower edge 130 of each tab 120 has a substantially curved contour. Preferably, the lower edge 130 is upwardly curved as shown in FIG. 6. The lower boundary 128 of the upper portion 116 of the overlay member 112 forms an upper edge 129 of each cutout 122 extending between the pair of vertical edges 124 and 126.

In the third embodiment, the underlay member 114 includes a layer of granules 132 on the front surface. Preferably, the layer of granules 132 is applied to the front surface with such a preciseness as to form one or more vertically-oriented underlay shading areas 134. The vertically-oriented underlay shading areas 134 have substantially vertical edges 140 and 141. The edge 141 is preferably substantially parallel to the edge 124 of the tab 120. A lower edge 143 of the underlay shading area has a substantially curved contour. Preferably, a portion of the lower edge 143 is upwardly curved as shown in FIG. 6. Preferably, the vertically-oriented underlay shading areas 134 are darker in appearance than a portion of a remainder of the underlay member 114, which can be covered with background granules of a lighter color.

As best shown in FIG. 6, each vertically-oriented underlay shading area 134 has a vertically-oriented longitudinal axis 136 that is substantially parallel to a vertical axis $V_2$ of the underlay member 114. Additionally, each cutout 122 is arranged such that the cutout vertical edge 124 is positioned between the vertical edges 140 and 141 of the underlay shading area 134, thereby exposing a portion of the vertically-oriented underlay shading area 134, and a portion of the lower edge 143, of the underlay member 114. As used herein, the term "vertical" means having an acute angle $a_3$ less than about 60 degrees as measured from a line substantially parallel to one of a vertical axis $V_1$ of the overlay member 112. Preferably, the angle $a_3$ is less than about 45 degrees. In the third embodiment, the underlay shading areas 134 are exposed within the cutout 122 only on a specific side of each tab 120, such as the right hand side, to provide a uniform shadow rendering design to the roof. However, it will be appreciated that the underlay shading areas 134 can be exposed only on the left hand side of the tabs, or any combination thereof.

It can be seen that the cutout vertical edge 124 is arranged so that it is positioned horizontally between the vertical edges 140 and 141 of the underlay shading area 134 of the underlay member 114, thereby exposing a portion of the vertical edge 141 and a portion of the underlay shading area lower edge 143 of the underlay member 114. Also, it can be seen that the right hand edges 141 of the vertically-oriented underlay shading areas 134 are arranged so that they are positioned between the vertical edges 124 and 126 of the cutouts 122, thereby exposing a portion of the vertically-oriented underlay shading area 134 of the underlay member 114.

As further shown in FIGS. 6 and 7, the tab 120 may be described as having a vertically-oriented longitudinal axis $V_3$ substantially parallel to the vertical axis $V_1$ of the overlay member 112, the axis $V_3$ bisecting the curved lower edge 130 of the tab 120. The underlay shading area 134 may be described as having a vertically-oriented longitudinal axis $V_4$ substantially parallel to the vertical axis $V_2$ of the underlay member 114, the axis $V_4$ bisecting the curved lower edge 143 of the underlay shading area 134. The overlay member 112 and the underlay member 114 are arranged such that the tabs 120 cover a portion of the underlay shading area 134, whereby the vertically-oriented longitudinal axis $V_3$ of the tab 120 is horizontally offset from the vertically-oriented longitudinal axis $V_4$ of the underlay shading area, thereby exposing a portion of the lower edge 143 of the underlay shading area 134. In most other aspects, the third embodiment of the shingle 100 is substantially identical to the shingle 10 (FIG. 1).

Figure 8:
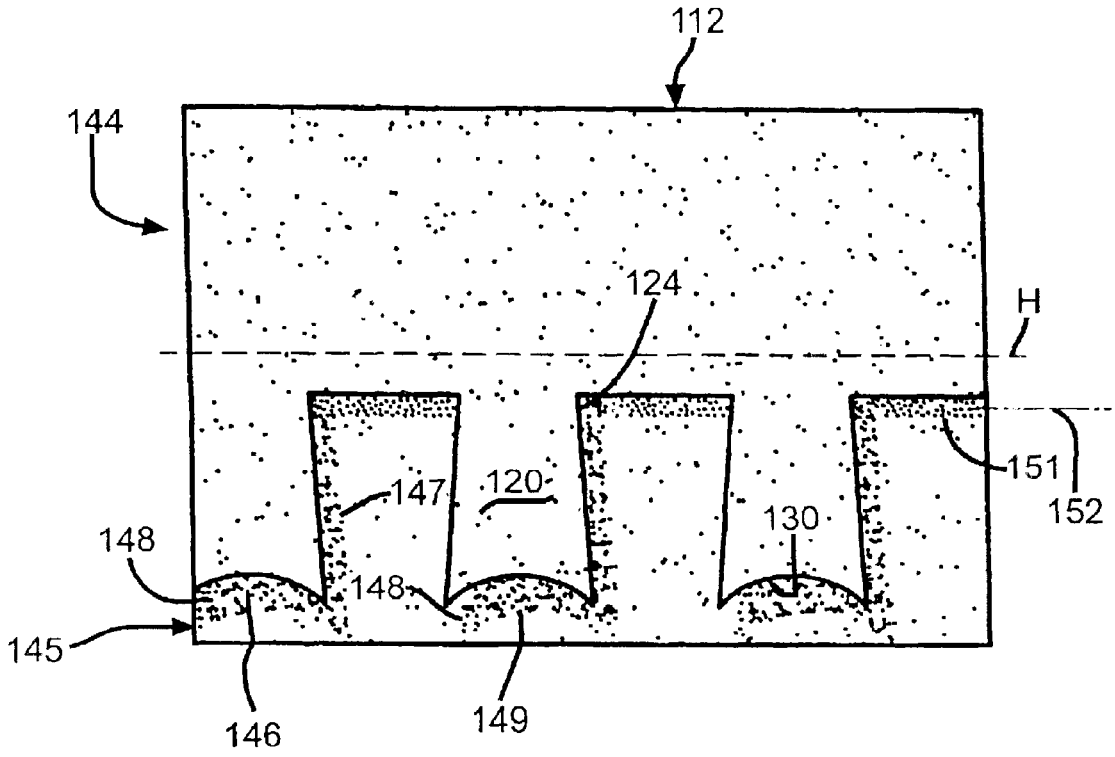
FIG. 8 is a plan view of a shingle with a rendered shadow design according to a fourth embodiment of the invention.

FIG. 8 illustrates a shingle 144 according to a fourth embodiment of the invention. In the fourth embodiment, the overlay member 112 is substantially identical to the overlay member 112 (FIG. 6) in the third embodiment. The underlay member 145 includes a vertically-oriented underlay shading area 146 having substantially vertical edges 147 and 148. The edge 147 is preferably substantially parallel to the edge 124 of the tab 120. A lower edge 149 of the underlay shading area 146 has a substantially curved contour. Preferably, the lower edge 149 is upwardly curved as shown in FIG. 8. Preferably, the vertically-oriented underlay shading areas 146 are darker in appearance than a portion of a remainder of the underlay member 145, which can be covered with background granules of a lighter color.

As best shown in FIG. 8, the curved lower edge 130 of the tab 120 is vertically offset from the curved lower edge 149 of the underlay shading area 146, thereby exposing the entire curved lower edge 149 of the underlay shading area 146.

Similar to the underlay described in the second embodiment (FIG. 4), the embodiment of the invention shown in FIG. 8 also includes a horizontally-oriented underlay shading area 151. Preferably, the horizontally-oriented underlay shading area 151 has a horizontally-oriented longitudinal axis 152 that is substantially parallel to the horizontal axis H of the underlay member 145. In most other aspects, the fourth embodiment of the shingle 144 is substantially identical to the shingle 10 (FIG. 1).

Figure 9:
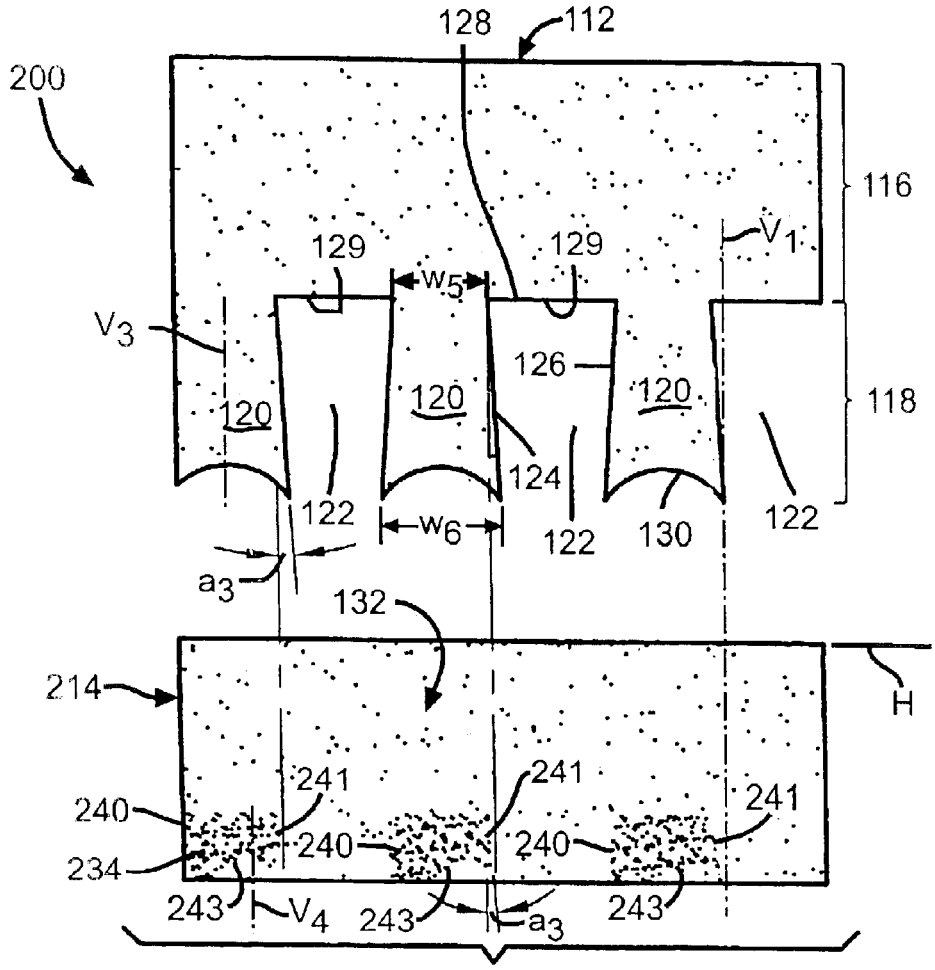
FIG. 9 is an exploded plan view of a shingle with a rendered shadow design according to a fifth embodiment of the invention.
Figure 10:
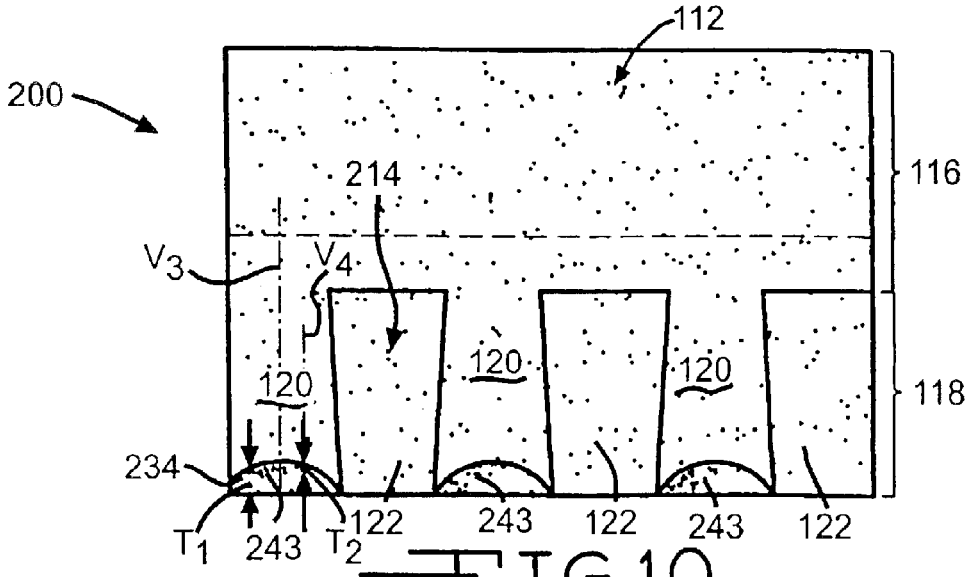
FIG. 10 is a plan view of the completed shingle of FIG. 9.

FIGS. 9 and 10 illustrate a shingle 200 according to a fifth embodiment of the invention. In the fifth embodiment, the overlay member 112 is substantially identical to the overlay member 112 (FIG. 6) in the third embodiment. The underlay member 214 is identical to the underlay member 114 of the third embodiment, except that the underlay shading area 234 does not include an exposed portion between the vertical edges 124 and 126 of the cutouts 122 of the overlay member 112.

The underlay shading area 234 includes substantially vertical edges 240 and 241. The edge 241 is preferably substantially parallel to the edge 124 of the tab 120. A lower edge 243 of the underlay shading area 234 has a substantially curved contour. Preferably, a portion of the lower edge 243 is upwardly curved as shown in FIG. 9. Preferably, the underlay shading areas 234 are darker in appearance than a portion of a remainder of the underlay member 214, which can be covered with background granules of a lighter color.

It can be seen that the tab 120 is arranged so that it covers a portion of the underlay shading area 234, thereby exposing a portion of the lower edge 243 of the underlay shading area 234. It can also be seen that the exposed portion of the lower edge 243 has a tapered appearance wherein the exposed portion of the lower edge 243 has a vertical thickness $T_1$ near one side of the curved lower edge 243 that is greater than a vertical thickness $T_2$ at the other side of the curved lower edge 243. In the fifth embodiment the exposed portion of the lower edge 243 tapers from the left side to the right side of the tab 120 to provide a uniform and realistic shadow rendering design on the roof. However, it will be appreciated that the exposed portion of the lower edges 243 of the underlay shading areas 234 can taper from the left side to the right side of the tab 120.

It will also be appreciated that the exposed portion of the lower edge 243 may have a tapered appearance wherein the exposed portion of the lower edge 243 tapers from a portion of the underlay shading area 234 having a vertical thickness $T_1$ near one side of the curved lower edge 243 to the other side of the curved lower edge 243 wherein the underlay shading area 234 has no thickness, or a thickness of zero. In most other aspects, the fifth embodiment of the shingle 200 is substantially identical to the shingle 10 (FIG. 1).

Figure 11:
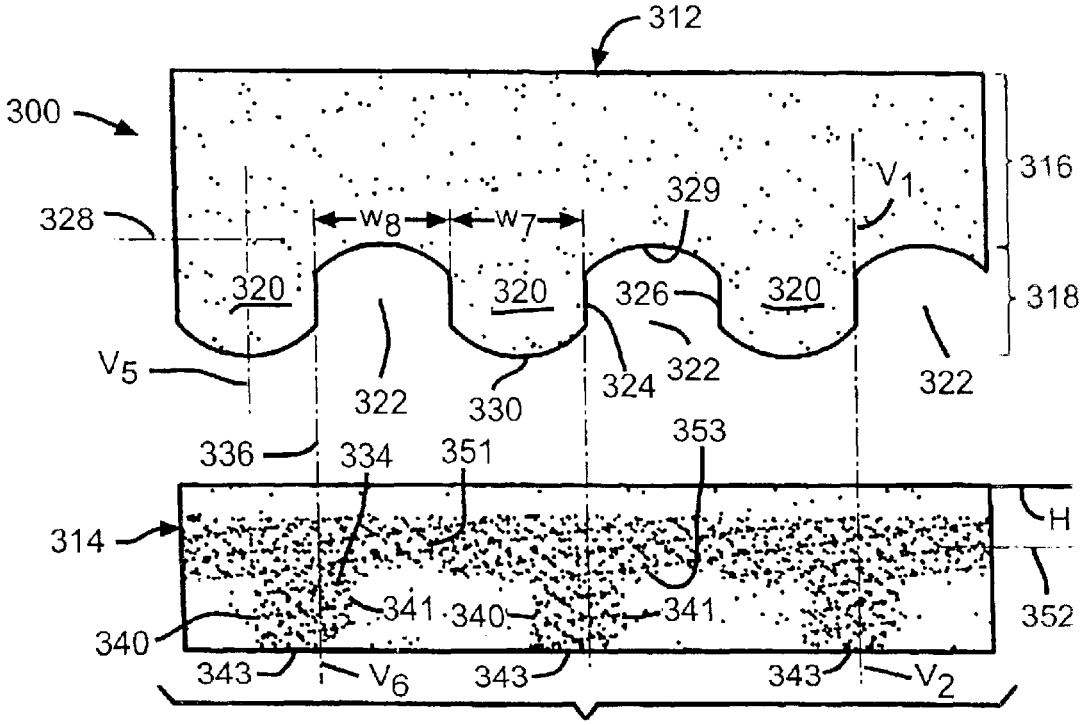
FIG. 11 is an exploded plan view of a shingle with a rendered shadow design according to a sixth embodiment of the invention.
Figure 12:
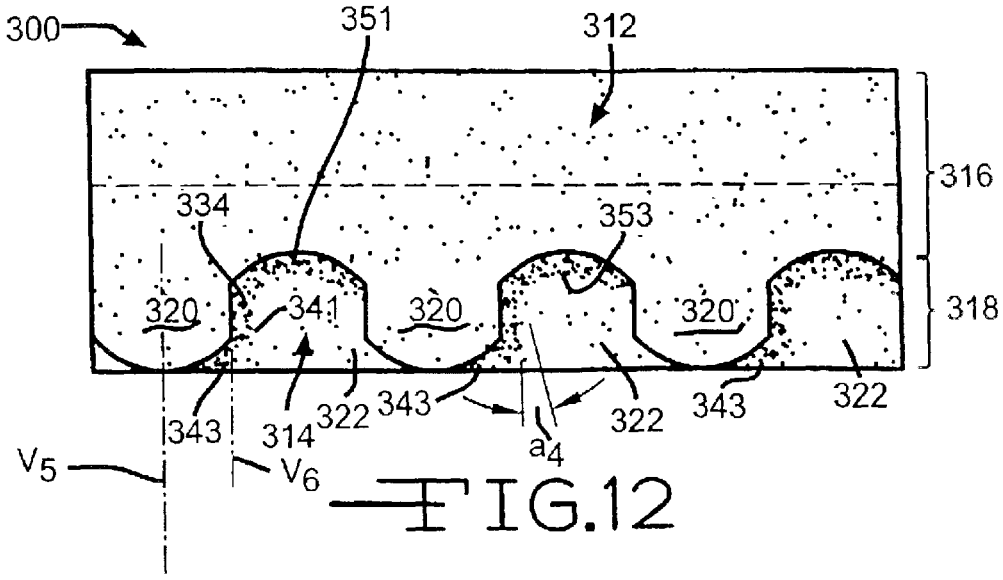
FIG. 12 is a plan view of the completed shingle of FIG. 11.

FIGS. 11 and 12 illustrate a shingle 300 according to a sixth embodiment of the invention. In the sixth embodiment, the overlay member 312 includes a headlap or upper portion 316 and an exposed butt or lower portion 318. The lower portion 318 includes one or more tabs 320 and preferably a series of tabs, which are separated from one another by one or more cutouts 322. Each cutout 322 includes a pair of spaced apart substantially parallel vertical edges 324 and 326 extending from a lower boundary 328 of the upper portion 316 of the overlay member 312 to a lower edge 330 of the tab 320. Preferably, a width $W_7$ of the tab 320 is substantially equal to a width $W_8$ of the cutout 322. However, it will be appreciated that the width $W_7$ of each tab 320 and the width $W_8$ of each cutout 322 can be selected to any desirable dimension. The lower edge 330 of each tab 320 has a substantially curved contour. Preferably, the lower edge 330 is downwardly curved as shown in FIG. 11. The lower boundary 328 of the upper portion 316 of the overlay member 312 forms an upper edge 329 of each cutout 322 extending between the pair of vertical edges 324 and 326. The upper edge 329 of the cutout has a substantially curved contour. Preferably, the upper edge 329 is upwardly curved as shown in FIG. 11.

In the sixth embodiment, the underlay member 314 includes a layer of granules applied to the front surface with such a preciseness as to form one or more vertically-oriented underlay shading areas 334. The vertically-oriented underlay shading areas 334 have substantially vertical edges 340 and 341. The edge 341 is preferably substantially parallel to the edge 324 of the tab 320. A lower edge 343 of the underlay shading area has a substantially curved contour. Preferably, a portion of the lower edge 343 is downwardly curved as shown in FIG. 11. Preferably, the vertically-oriented underlay shading areas 334 are darker in appearance than a portion of a remainder of the underlay member 314, which can be covered with background granules of a lighter color.

As best shown in FIG. 11, each vertically-oriented underlay shading area 334 has a vertically-oriented longitudinal axis 336 that is substantially parallel to a vertical axis $V_2$ of the underlay member 314. Additionally, each cutout 322 is arranged such that the cutout vertical edge 324 is positioned between the vertical edges 340 and 341 of the underlay shading area 334, thereby exposing a portion of the vertically-oriented underlay shading area 334, and a portion of the lower edge 343, of the underlay member 314. As used herein, the term "vertical" means having an acute angle $a_4$ less than about 60 degrees as measured from a line substantially parallel to one of a vertical axis $V_1$ of the overlay member 112. Preferably, the angle $a_4$ is less than about 45 degrees.

The shingle 300 may also be described wherein the tab 320 is arranged so that it covers a portion of the underlay shading area 334, thereby exposing a portion of the underlay shading area lower edge 343, and exposing a portion of the substantially vertical edge 341 of the underlay shading area 343.

In the sixth embodiment, the underlay shading areas 334 are exposed within the cutout 322 only on a specific side of each tab 320, such as the right hand side, to provide a uniform shadow rendering design to the roof. However, it will be appreciated that the underlay shading areas 334 can be exposed only on the left hand side of the tabs, or any combination thereof.

It can be seen that the cutout vertical edge 324 is arranged so that it is positioned horizontally between the vertical edges 340 and 341 of the underlay shading area 334 of the underlay member 314, thereby exposing a portion of the vertical edge 341 and a portion of the underlay shading area lower edge 343 of the underlay member 314. Also, it can be seen that the right hand edges 341 of the vertically-oriented underlay shading areas 334 are arranged so that they are positioned between the vertical edges 324 and 326 of the cutouts 322, thereby exposing a portion of the vertically-oriented underlay shading area 334 of the underlay member 314.

As further shown in FIGS. 11 and 12, the tab 320 may be described as having a vertically-oriented longitudinal axis $V_5$ substantially parallel to the vertical axis $V_1$ of the overlay member 312, the axis $V_5$ bisecting the curved lower edge 330 of the tab 320. The underlay shading area 334 may be described as having a vertically-oriented longitudinal axis $V_6$ substantially parallel to the vertical axis $V_2$ of the underlay member 314, the axis $V_6$ bisecting the curved lower edge 343 of the underlay shading area 334. The overlay member 312 and the underlay member 314 are arranged such that the tabs 320 cover a portion of the underlay shading area 334, and the vertically-oriented longitudinal axis $V_5$ of the tab 320 is horizontally offset from the vertically-oriented longitudinal axis $V_6$ of the underlay shading area 334, thereby exposing a portion of the lower edge 343 of the underlay shading area 334.

Similar to the underlay described in the second embodiment (FIG. 4), the embodiment of the invention shown in FIGS. 11 and 12 also includes a horizontally-oriented underlay shading area 351. Preferably, the horizontally-oriented underlay shading area 351 has a horizontally-oriented longitudinal axis 352 that is substantially parallel to the horizontal axis H of the underlay member 314. A portion of the lower edge 353 of the horizontally-oriented shading area 351 has a substantially curved contour. Preferably, a portion of the lower edge 353 is upwardly curved as shown in FIG. 11. In most other aspects, the sixth embodiment of the shingle 300 is substantially identical to the shingle 10 (FIG. 1).

Figure 13:
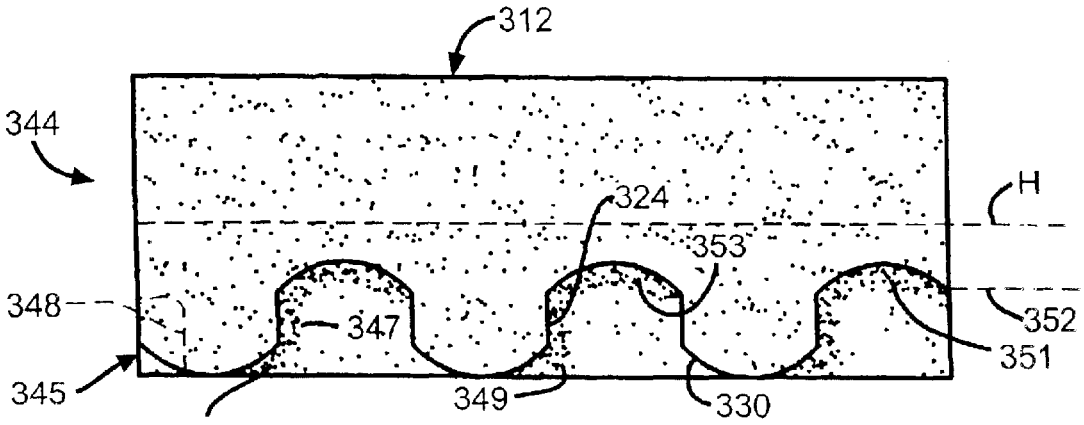
FIG. 13 is a plan view of a shingle with a rendered shadow design according to a seventh embodiment of the invention.

FIG. 13 illustrates a shingle 344 according to a seventh embodiment of the invention. In the seventh embodiment, the overlay member 312 is substantially identical to the overlay member 312 (FIG. 11) in the sixth embodiment. The underlay member 345 includes a vertically-oriented underlay shading area 346 having substantially vertical edges 347 and 348. The edge 347 is preferably substantially parallel to the edge 324 of the tab 320. A lower edge 349 of the underlay shading area 346 has a substantially curved contour. Preferably, the lower edge 349 is downwardly curved as shown in FIG. 13. The underlay member 345 also includes horizontally-oriented underlay shading area 351 having substantially curved lower edge 353. Preferably, a portion of the lower edge 353 is upwardly curved as shown in FIG. 13. Preferably, the vertically-oriented underlay shading areas 346 are darker in appearance than a portion of a remainder of the underlay member 345, which can be covered with background granules of a lighter color.

As best shown in FIG. 13, the curved lower edge 330 of the tab 320 is vertically offset from the curved lower edge 349 of the underlay shading area 346, thereby exposing the entire curved lower edge 349 of the underlay shading area 146, and exposing a portion of the curved lower edge 353 of the horizontally-oriented underlay shading area 351. In most other aspects, the seventh embodiment of the shingle 344 is substantially identical to the shingle 10 (FIG. 1).

Figure 14:
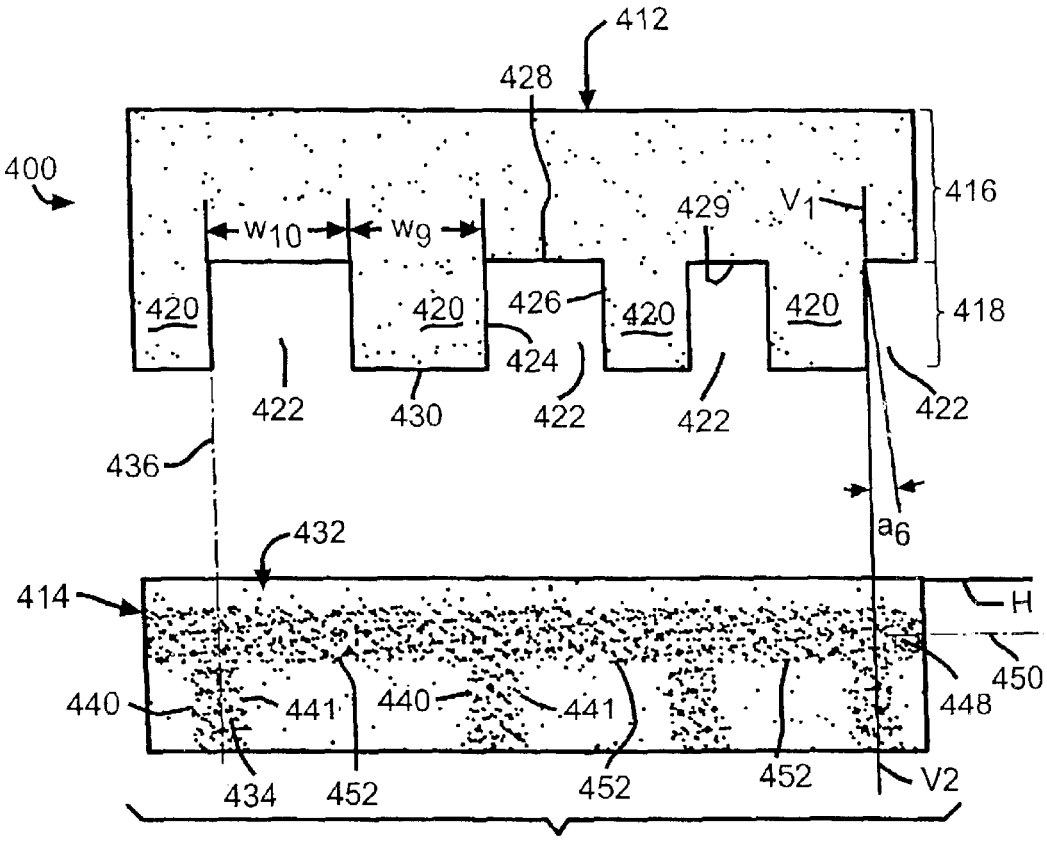
FIG. 14 is an exploded plan view of a shingle with a rendered shadow design according to an eighth embodiment of the invention.
Figure 15:
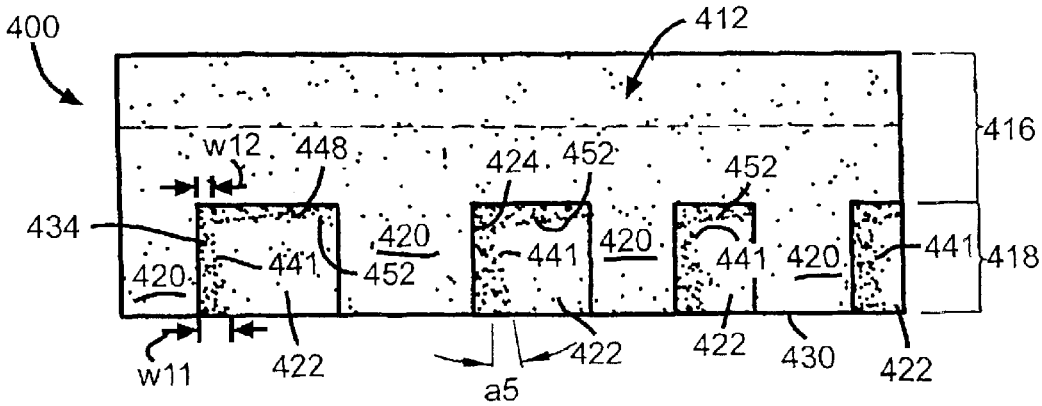
FIG. 15 is a plan view of the completed shingle of FIG. 14.

FIGS. 14 and 15 illustrate a shingle 400 according to an eighth embodiment of the invention. In the eighth embodiment, the overlay member 412 includes a headlap or upper portion 416 and an exposed butt or lower portion 418. The lower portion 418 includes one or more tabs 420 and preferably a series of tabs, which are separated from one another by one or more cutouts 422. Each cutout 422 includes a pair of spaced apart vertical edges 424 and 426 extending from a lower boundary 428 of the upper portion 416 of the overlay member 412 to a lower edge 430 of the tab 420. It will be appreciated that the width $W_9$ of each tab 420, and the width $W_{10}$ of each cutout 422 can be selected to any desirable dimension. In the eighth embodiment, the vertical edges 424 and 426 of each cutout 422 are substantially parallel to each other. The lower boundary 428 of the upper portion 416 of the overlay member 412 forms an upper edge 429 of each cutout 422 extending between the pair of vertical edges 424 and 426.

In the eighth embodiment, the underlay member 414 includes a layer of granules 432 applied to the front surface with such a preciseness as to form one or more vertically-oriented underlay shading areas 434. The vertically-oriented underlay shading areas 434 have substantially vertical edges 440 and 441. The edge 441 is preferably at an acute angle $a_5$ from a line parallel to the edge 424 of the tab 420. It will be appreciated that the angle $a_5$ may be any suitable angle. Preferably, the vertically-oriented underlay shading areas 434 are darker in appearance than a portion of a remainder of the underlay member 414, which can be covered with background granules of a lighter color.

As best shown in FIG. 14, each vertically-oriented underlay shading area 434 has a vertically-oriented longitudinal axis 436 that is substantially parallel to a vertical axis $V_2$ of the underlay member 414. Additionally, each cutout 422 is arranged such that the cutout vertical edge 424 is positioned between the vertical edges 440 and 441 of the underlay shading area 434, thereby exposing a portion of the vertically-oriented underlay shading area 434, and a portion of the lower edge 443, of the underlay member 414. As used herein, the term "vertical" means having an acute angle $a_6$ less than about 60 degrees as measured from a line substantially parallel to one of a vertical axis $V_1$ of the overlay member 412. Preferably, the angle $a_6$ is less than about 45 degrees. In the eighth embodiment, the underlay shading areas 434 are exposed within the cutout 422 only on a specific side of each tab 420, such as the right hand side, to provide a uniform and realistic shadow rendering design to the roof. However, it will be appreciated that the underlay shading areas 434 can be exposed only on the left hand side of the tabs, or any combination thereof.

In addition, in the embodiment of the invention shown in FIGS. 14–15, the layer of granules 432 also forms a horizontally-oriented underlay shading area 448. Preferably, the horizontally-oriented underlay shading area 448 has a horizontally-oriented longitudinal axis 450 that is substantially parallel to a horizontal axis H of the underlay member 414. It will be appreciated that at least a portion of a lower edge 452 of the horizontally-oriented underlay shading area 448 may be arranged in a non-parallel fashion relative to the upper edge 429 of the cutout 422, an exposed portion of the horizontally-oriented underlay shading area 448 thereby having a substantially tapered appearance.

It can be seen that the cutout vertical edge 424 is arranged so that it is positioned horizontally between the vertical edges 440 and 441 of the underlay shading area 434 of the underlay member 414, thereby exposing a portion of the vertical edge 441. Preferably, a width $w_{11}$ of the exposed portion of the underlay shading area 434 at the lower edge 430 of the lower portion 418 of the overlay member 412 is larger than a width $w_{12}$ of the exposed portion of the underlay shading area 434 at the lower boundary 428 of the upper portion 416 of the overlay member 412. The shape of the exposed portion of the underlay shading area 434 creates the illusion of an uneven tab 420 thickness. For example, an exposed portion of the underlay shading area 434 that has a tapered appearance as shown in FIG. 15 would create the illusion of a tab 420 that is thick at the bottom and tapers to a lesser thickness at the top.

Also, it can be seen that the right hand edges 441 of the vertically-oriented underlay shading areas 434 are arranged so that they are positioned between the vertical edges 424 and 426 of the cutouts 422, thereby exposing a portion of the vertically-oriented underlay shading area 434 of the underlay member 414. In most other aspects, the eighth embodiment of the shingle 400 is substantially identical to the shingle 10 (FIG. 1). It will be appreciated that the shading areas described in FIGS. 1–15 can be applied to any size shingle, and to shingles with various tab shapes and various tab dimensions.

Although the eight embodiments of the invention described above depict a series of uniform tabs and uniform shading areas extending from one edge of the shingle to the other edge of the shingle, it will be understood that the shading areas of any of the eight embodiments may extend across only a portion of the width of the shingle. Additionally, it will be understood that any of the shadow rendering designs described above may be combined with any of the shingle designs described above, or may be combined with any other shingle design.

In further alternative embodiments of the present invention, the overlay in each of the embodiments (e.g. 12 in FIGS. 1–3) may include a shadow (not shown) about part or all of the periphery of one or more the cutouts 22. Furthermore, the granules provide in the shadows may be darker or lighter than the colored granules on the tabs 20, and/or the shading area 38. Accordingly, the granules of the shading area 38, although generally described as being of a darker color than those visible in the cutouts 22, may be of a lighter color than visible in the cutout 22 and/or on the tabs 20. For this purpose, although generally called a shadow, such lighter granules comprise a highlight or accent color, which is generally lighter than the granules on the tabs, and therefore a shadow should not be construed to mean only a darker color. Such a shadow with an accent color or highlight would accentuate different layers. In a further alternative embodiment, the present invention may be accomplished using three or more layers, in which case the shadow area (e.g. 38) may be simply an middle layer containing darker (or lighter) granules between the overlay 12 and underlay 14. In these embodiments, the shadow may be provided solely by the middle layer, or alternatively, as described above, the underlay 14 or overlay 12 may also include shadowing to accomplish further dimensionality in the laminated shingle. Although these embodiments refer to FIGS. 1–3, they may be universally applied to any embodiment of the present invention.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A laminated shingle, comprising:

an overlay member having a front surface, a rear surface, an upper portion and a lower portion, the lower portion including one or more tabs having non-parallel vertical edges, the tabs being separated by cutouts, at least one cutout including a pair of spaced apart non-parallel vertical edges extending from a lower boundary of the upper portion of the overlay member to a lower edge of the lower portion of the overlay member, a width of the at least one tab at the lower boundary of the upper portion of the overlay member being larger than a width of the at least one tab at the lower edge of the lower portion of the overlay member, at least one cutout also including an upper edge extending between the pair of cutout vertical edges; and an underlay member having a front surface attached to the rear surface of the overlay member, the underlay member including a layer of granules on the front surface to form at least one vertically-oriented underlay shading area having two substantially vertical edges, at least one edge of the underlay shading area being substantially parallel to an edge of the tab of the overlay member, the vertically-oriented underlay shading area having granules of different color or shade in appearance than a portion of a remainder of the underlay member;

wherein one of the cutout vertical edges is arranged so that it is positioned between the vertical edges of the underlay shading area, thereby exposing a portion of the vertically-oriented underlay shading area.

2. The laminated shingle according to claim 1, wherein the underlay member further includes at least one horizontally-oriented underlay shading area having a horizontally-oriented longitudinal axis being substantially parallel to a horizontal vas of the underlay member, and wherein the horizontally-oriented longitudinal axis of the at least one horizontally-oriented underlay shading arcs of the underlay member substantially aligns with the upper edge of at least one cutout of the overlay member, thereby exposing a portion of the at least one horizontally-oriented underlay shading area.

3. A laminated shingle, comprising:

an overlay member having a front surface, a rear surface, an upper portion and a lower portion, the lower portion including one or more tabs having non-parallel vertical edges, the tabs being separated by cutouts, at least one cutout including a pair of spaced apart non-parallel vertical edges extending from a lower boundary of the upper portion of the overlay member to a lower edge of the lower portion of the overlay member, a width of the at least one tab at the lower boundary of the upper portion of the overlay member being larger than a width of the at least one tab at the lower edge of the lower portion of the overlay member, at least one cutout also including an upper edge extending between the pair of cutout vertical edges; and an underlay member having a front surface attached to the rear surface of the overlay member, the underlay member including a layer of granules on the front surface to form at least one vertically-oriented underlay shading area having two substantially vertical edges, at least one edge of the underlay shading area being substantially parallel to an edge of the tab of the overlay member, the vertically-oriented underlay shading area being darker in appearance than a portion of a remainder of the underlay member;

wherein one of the cutout vertical edges is arranged so that it is positioned between the vertical edges of the underlay shading area, thereby exposing a portion of the vertically-oriented underlay shading area.

4. The laminated shingle according to claim 3, wherein the underlay member further includes at least one horizontally-oriented underlay shading area having a horizontally-oriented longitudinal axis being substantially parallel to a horizontal axis of the underlay member, and wherein the horizontally-oriented longitudinal axis of the at least one horizontally-oriented underlay shading area of the underlay member substantially aligns with the upper edge of at least one cutout of the overlay member, thereby exposing a portion of the at least one horizontally-oriented underlay shading area.

5. A laminated shingle comprising:

an overlay member having a front surface, a rear surface, an upper portion and a lower portion, the lower portion including one or more tabs having non-parallel vertical edges, the tabs being separated by cutouts, at least one cutout including a pair of spaced apart non-parallel vertical edges extending from a lower boundary of the upper portion of the overlay member to a lower edge of the lower portion of the overlay member, a width of the at least one tab at the lower boundary of the upper portion of the overlay member being larger than a width of the at least one tab at the lower edge of the lower portion of the overlay member, at least one cutout also including an upper edge extending between the pair of cutout vertical edges; and an underlay member having a front surface attached to the rear surface of the overlay member, the underlay member including a layer of granules on the front surface to form at least one vertically-oriented underlay shading area having two substantially vertical edges, at least one edge of the underlay shading area being substantially parallel to an edge of the tab of the overlay member, the vertically-Oriented underlay shading area having granules of different appearance than a portion of a remainder of the underlay member;

wherein one of the cutout vertical edges is arranged so that it is positioned between the vertical edges of the underlay shading area, thereby exposing a portion of the vertically-oriented underlay shading area.

6. The laminated shingle according to claim 5, wherein the underlay member further includes at least one horizontally-oriented underlay shading area having a horizontally-Oriented longitudinal axis being substantially parallel to a horizontal axis of the underlay member, and wherein the horizontally-oriented longitudinal axis of the at least one horizontally-oriented underlay shading area of the underlay member substantially aligns with the upper edge of at lees: one cutout of the overlay member, thereby exposing a portion of the at least one horizontally-oriented underlay shading area.

* * * * *

UNITED STATES PATENT AND TRADEMARK OFFICE

CERTIFICATE OF CORRECTION

PATENT NO. : 6,823,637 B2
APPLICATION NO. : 10/334356
DATED : November 30, 2004
INVENTOR(S) : Elliott It is certified that error appears in the above-identified patent and that said Letters Patent is hereby corrected as shown below:

Claim 2, Column 16, Line 39, “vas” should read --axis--
Claim 5, Column 18, Line 11, “Oriented” should read --oriented--
Claim 6, Column 18, Line 21, “Oriented” should read --oriented--
Claim 6, Column 18, Line 26, “lees” should read --least--

Signed and Sealed this

Seventh Day of August, 2007

JON W. DUDAS
*Director of the United States Patent and Trademark Office*